United States Patent [19]

Gibbs

[11] 4,429,870

[45] Feb. 7, 1984

[54] PHYSICAL EXERCISING APPARATUS

[76] Inventor: Thomas T. Gibbs, 1539 Edgeware Rd., Victoria, British Columbia, Canada, V8T 2J6

[21] Appl. No.: 228,763

[22] Filed: Jan. 27, 1981

[51] Int. Cl.[3] ..... A63B 21/06

[52] U.S. Cl. ..... 272/117; 272/143

[58] Field of Search ..... 272/117, 143, DIG. 4, 272/93, 128, 116, 119, 126; 280/200, 217; 74/551.1

[56] References Cited

U.S. PATENT DOCUMENTS

| | | | |
|---|---|---|---|
| 1,329,940 | 2/1920 | Wallace | 280/217 |
| 3,094,324 | 6/1963 | Shingleton | 272/117 X |
| 3,672,361 | 6/1972 | Fourneron | 272/93 X |
| 3,820,781 | 6/1974 | Kane | 272/126 |

FOREIGN PATENT DOCUMENTS

| | | | |
|---|---|---|---|
| 2061118 | 5/1981 | United Kingdom | 272/70.3 |

*Primary Examiner*—Richard J. Apley
*Assistant Examiner*—William R. Browne
*Attorney, Agent, or Firm*—Carver & Co.

[57] ABSTRACT

An exerciser includes a pair of elongate, parallel members having adjacent first ends and adjacent second ends opposite the first ends. A pair of handle members are near the first ends of the parallel members. The handle members are elongate and extend outwardly from the parallel members and away from each other. A weight member interconnects the parallel members near the second ends thereof.

6 Claims, 14 Drawing Figures

FIG 1
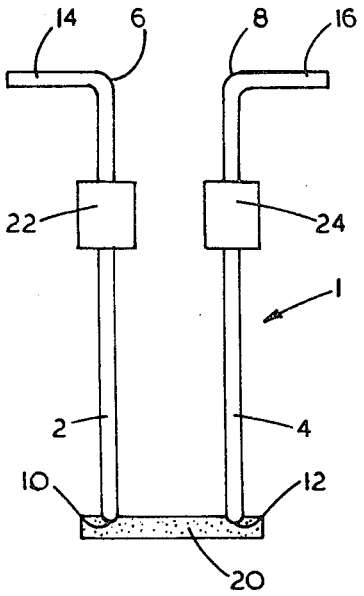
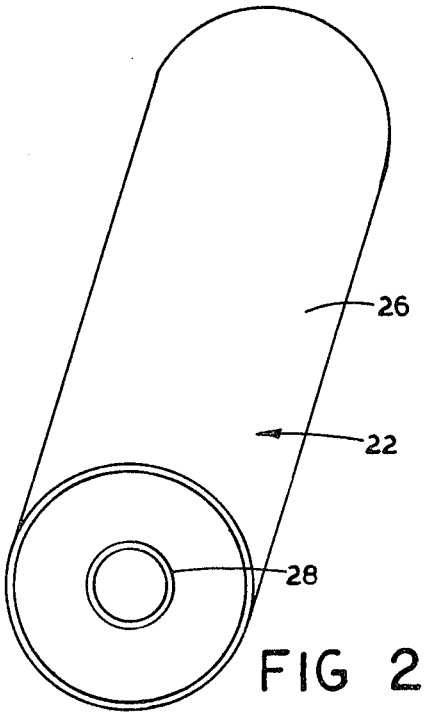
FIG 2
FIG 3
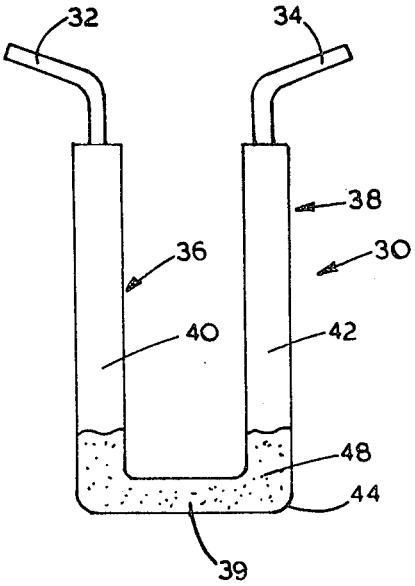
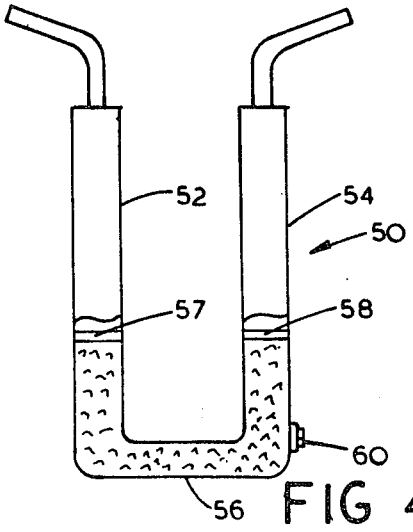
FIG 4

FIG 5
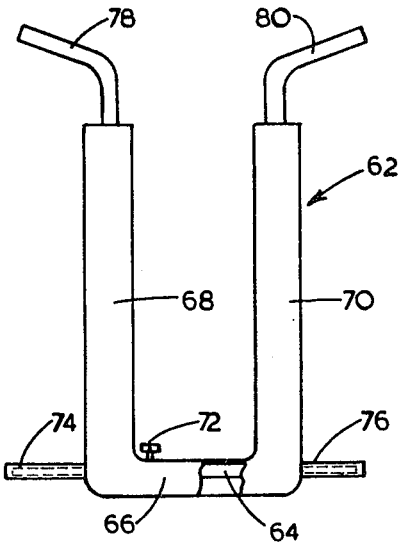
FIG 6
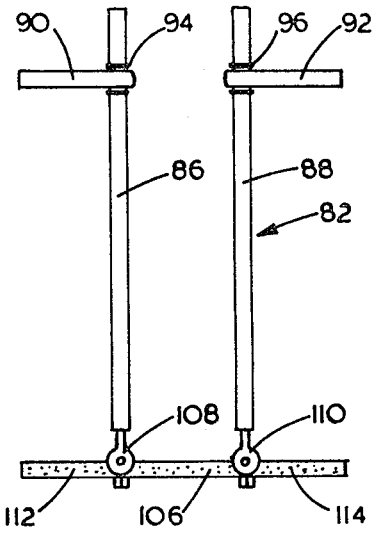
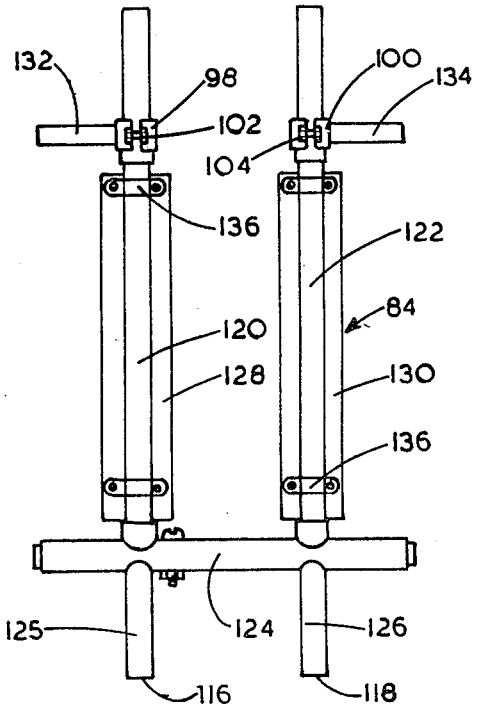
FIG 7

PHYSICAL EXERCISING APPARATUS

BACKGROUND OF THE INVENTION

This invention relates to an apparatus designed to exercise the skeletal muscles employing the forces of gravity, momentum and counterbalance.

It is well known that there are two aspects of muscular development—isotonic and isometric. Isotonic is a reference to tonal quality, smooth operation and range of operation. Isometric is a reference to size and the ability to resist movement of the musculature. Both aspects are equally valuable and, ideally, should occur in conjunction with each other. This can be accomplished by attempting to control the effect of a moving weight at the end of a longitudinal arm. As the weight comes to the end of a swing, the muscles of the body stop the movement of the weight to protect the body from injury. The inertial effects cause the weight to tend to continue a swing in a particular direction. In resisting this motion, the muscles are stretched a bit further than normal. As long as this overswing is fully controlled, it can be used to progressively increase the muscular range. The muscles may also be used to hold the weight at the end of the maximum swing. The strain of doing this will cause the muscles to take on a new "set".

In the prior art, U.S. Pat. No. 3,094,324 to Shingleton discloses an exerciser with a central shaft, arm members for gripping the device and a weight attached to the central shaft near the bottom thereof. However, the positioning of the arm members and the general configuration of this device make it difficult to carry out many useful exercises.

U.S. Pat. No. 3,290,044 to Krodsen discloses a mobile exercise bar. It is, however, not adapted for use as a swinging weight.

U.S. Pat. No. 3,468,534 to Donato shows an exercise bar having revolvable arms.

Related exercising devices are shown, for example, in U.S. Pat. Nos. 2,909,371 to Alcover; 3,228,683 to Leteff; 3,531,111 to Shafer and 4,023,796 to Kusmer.

These prior art inventions do not disclose a relatively simple exercising device adapted for convenient use in a considerable number of different exercises employing a swinging weight to accomplish muscular development.

SUMMARY OF THE INVENTION

According to the invention, an exerciser comprises a pair of elongate, parallel members having adjacent first ends and adjacent second ends opposite the first ends. A pair of handle members are near the first ends of the parallel members. The handle members are elongate and extend outwardly from the parallel members and away from each other. A weight member interconnects the parallel members near the second ends thereof.

BRIEF DESCRIPTION OF THE DRAWINGS

FIG. 1 is an elevational view of an exerciser according to a first embodiment of the invention, FIG. 2 is an enlarged isometric view of one of the shoulder rests from the embodiment of FIG. 1, FIG. 3 is an elevational view of an exerciser according to a second embodiment of the invention, FIG. 4 is an elevational view, partly broken away, of an exerciser according to a third embodiment of the invention, FIG. 5 is an elevational view of an exerciser according to a fourth embodiment of the invention, FIG. 6 is an elevational view of an exerciser according to a fifth embodiment of the invention, FIG. 7 is an elevational view of an exerciser according to a sixth embodiment of the invention.

DESCRIPTION OF THE PREFERRED EMBODIMENTS

Figure 8:
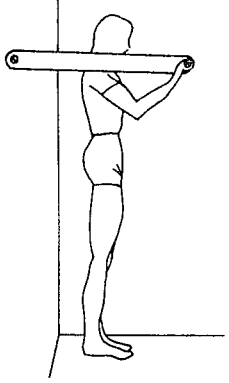
FIGS. 8 and 9 are elevational views showing an exerciser according to the invention being used by a person in a side-to-side swinging exercise.

FIG. 1 illustrates an exerciser 1 which has a pair of elongate, parallel members 2 and 4 having adjacent first ends 6 and 8 and adjacent second ends 10 and 12 opposite the first ends. A pair of handle members 14 and 16 are connected to the parallel members at the first ends. The handle members are elongate and extend outwardly from the parallel members and away from each other. In this embodiment, the handle members are perpendicular to the parallel members. The parallel members and the handle members are constructed of metal tubing in this embodiment. The parallel members are circular tubes with equal outside diameters. Alternatively, the parallel members could be of a solid material, such as plastic or wood, and could have triangular, square or rectangular cross-sections.

A weight member 20, comprising a bar of suitable weight, interconnects the parallel members at the second ends 10 and 12.

Shoulder rests 22 and 24 are slidably received on the parallel members. If desired, however, the shoulder rests could be rigidly fixed to the parallel members. The shoulder rests are identical and, as shown in FIG. 2, for shoulder rest 22, each comprises a hollow tube with an outside shell 26 having a diameter substantially larger than the outside diameter of the parallel members and an inner shell 28 forming a bearing for sliding on the parallel members and having an inside diameter generally equal to the outside diameter of the parallel members. The shoulder rests provide more comfort when the exerciser rests on the user's shoulders.

FIG. 3 shows an exerciser 30 according to another embodiment of the invention wherein the handle members 32 and 34 are angled obtusely with respect to the parallel members 36 and 38 and extend away from the weight member 39. The handle members comprise tubes with equal outside diameters.

Exerciser 30 has elongate, cylindrical bearing surfaces 40 and 42 on each of the parallel members between the handle members 32 and 34 and the weight member 39. The bearing surfaces provide comfort when the parallel members rest on the user's shoulders and have outside diameters substantially greater than the outside diameters of the handle members. In this embodiment, the bearing surfaces and the weight member 39 comprise an integral U-shaped tube 44. The tube 44 also provides means for retaining a weight in the weight member. The bottom portion of the tube 44 is simply filled with concrete to provide the desired weight. The weight member thus holds the weight as required.

FIG. 4 shows an exerciser 50 substantially the same as the exerciser of FIG. 3, so it will be described only with respect to the differences. Instead of filling the weight member with concrete, a water container is provided at the lower ends of the parallel members 52 and 54 and the weight member 56 to provide the required weight. Suitable bulkheads 57 and 58 are provided in the parallel members and a filler cap 60 is threadedly received near the bottom of parallel member 54 to fill the container with water.

The exerciser 62 of FIG. 5 is again generally similar to those of FIGS. 3 and 4. In this case, however, the weight comprises a bar 64 extending through the weight member 66 perpendicularly to the parallel members 68 and 70 and secured by set screw 72. The bar 64 also passes through the plastic tubes 74 and 76 extending perpendicularly outwards from parallel members 68 and 70 near the bottoms thereof. These tubes provide additional hand grips for the exerciser in addition to handle members 78 and 80 which correspond to those of the previous embodiments.

FIGS. 6 and 7 show exerciser 82 and 84, respectively, which have generally similar adjustment features which allow the configuration of the exercisers to be varied for a particular individual's requirements. The parallel members 86 and 88 of exerciser 82 comprise straight elongate tubes which are circular in section. Handle members 90 and 92 are tubes of a similar diameter and are connected to the parallel members by clamps 94 and 96 which are similar to the clamps 98 and 100 as shown in FIG. 7 for exerciser 84. As shown for exerciser 84, the clamps have corresponding sets of nuts and bolts 102 and 104 which permit the clamps to be loosened. This permits adjustment of the handle members 90 and 92 along the parallel members 86 and 88 and permits rotation of the handle members of both the parallel members to a different angular position as required. When the nuts and bolts are tightened, the clamps serve to secure the handle members to the parallel members.

The parallel members 86 and 88 are releasably secured to the weight member 106 by means of a second pair of clamps 108 and 110. When these clamps are loosened, the parallel members can be moved along the weight member 106, which comprises an elongate bar, to vary the distance between the parallel members as required. When the parallel members 86 and 88 are positioned as shown in FIG. 6, the weight member has end portions 112 and 114 extending outwardly beyond the parallel members which serve as additional hand grips.

As mentioned, the embodiment of FIG. 7 is similar to that of FIG. 6. However, in this case, the second or bottom ends 116 and 118 of parallel members 120 and 122, respectively, extend beyond the weight member 124 to form extended hand grips 125 and 126.

Exerciser 84 of FIG. 7 also includes shoulder rests 128 and 130 between the handle members 132 and 134 and the weight member 124. The shoulder rests comprise elongate, flat boards secured to the parallel members 120 and 122 by the fittings 136 at opposite ends thereof.

Figure 9:
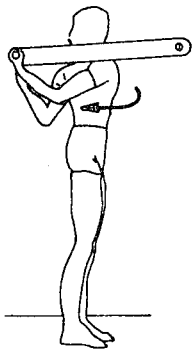

FIGS. 8 to 14 illustrate persons using the embodiments of the invention for various exercises. FIG. 8 illustrates the basic starting position. From here, the exerciser may be caused to slide forward or backwards on the shoulder blades, rolled to some extent from side to side or pivotted on the shoulder blades. FIG. 9 shows a full body twist with the momentum carrying the torso to a full turn which is then held. It may be appreciated that the weight member may be held to the front or the back.

Figure 10:
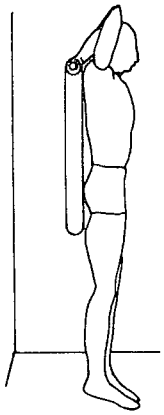
FIGS. 10 and 11 are elevational views of an exerciser according to the invention being used by a person in a forward swinging exercise.
Figure 11:
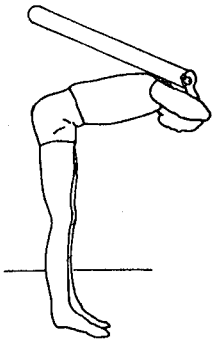

FIG. 10 shows the straight downward pull of the weight member which in turn causes the shoulders to go back, the spinal column to straighten and the chest to lift upwards. FIG. 11 shows a forward bend with necessary abdominal contraction.

Figure 12:
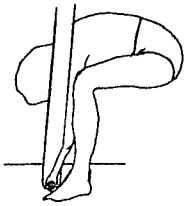
FIGS. 12 and 13 are elevational views of an exerciser according to the invention being used by a person in a vertical stretching exercise.
Figure 13:
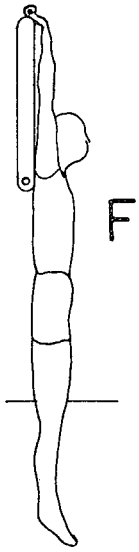

FIG. 12 shows a full forward bend and squat. In this case, the weight member is forward. FIG. 13 illustrates a full back upthrust showing the necessary horizontal hand grip.

Figure 14:
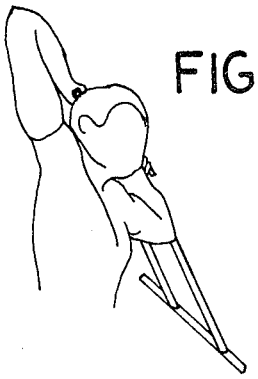
FIG. 14 is a perspective view of an exerciser according to the invention being used by a person with one hand as a pivot and the other hand holding the exerciser at the end of a swing.

FIG. 14 shows how one hand can be used as a pivot and the other for holding the apparatus over for a moment, rather than having it bounce right back after a swing.

It may be seen that the invention promotes a greater range of full-body exercises because the use of two hands to control the movement of a swinging weight gives the user the confidence to swing the weight to a greater degree. The handle members are placed to accommodate the anatomy and allow the arms and hands to firmly control the movement as required.

What is claimed is:

1. An exerciser comprising:

(a) a pair of elongate, parallel members having adjacent first ends and adjacent second ends opposite the first ends, (b) a pair of handle members near the first ends of the parallel members, the handle members being elongate and extending outwardly from the parallel members and away from each other, a weight member, each of said handle members comprising tubes with equal outside cross-sectional extents, the exerciser further comprising a cylindrical bearing surface on each said parallel member between the handle members and the weight member, the bearing surfaces having outside cross-sectional extents substantially greater than the outside cross-sectional extents of the handle member; said exerciser being gripped and moved doing various exercises, said bearing surface engaging the shoulders of a user; and (c) said weight member interconnecting the parallel members near the second ends thereof and said weight member being substantially heavier than the parallel members.

2. An exerciser as claimed in claim 1, the bearing surfaces and the weight member comprising an integral U-shaped tube.

3. An exerciser as claimed in claim 2 comprising a weight supported by the weight member.

4. An exerciser as claimed in claim 3, the weight comprising concrete.

5. An exerciser as claimed in claim 1, the handle members being angled obtusely with respect to the parallel members and extending away from the weight member.

6. An exerciser comprising:

(a) a pair of elongate, parallel members having adjacent first ends and adjacent second ends opposite the first ends, (b) a pair of handle members near the first ends of the parallel members, the handle members being elongate and extending outwardly from the parallel members and away from each other, (c) a weight member interconnecting the parallel members near the second ends thereof, and shoulder rests on the parallel members between the handle members and the weight member.

* * * * *